US005564918A

United States Patent [19]

Lin

[11] Patent Number: 5,564,918

[45] Date of Patent: Oct. 15, 1996

[54] GAS TORCH

[76] Inventor: Arlo H. T. Lin, No. 5, Lane 25, Tatung Rd., Wu Fong, Hsiang, Taichung Hsien, Taiwan

[21] Appl. No.: 472,949

[22] Filed: Jun. 6, 1995

[51] Int. Cl.[6] ..... F23D 14/28

[52] U.S. Cl. ..... 431/255; 431/266; 431/344

[58] Field of Search ..... 431/344, 345, 431/255, 256, 266, 277; 126/401, 405–407, 413, 414

[56] References Cited

U.S. PATENT DOCUMENTS

| | | | |
|---|---|---|---|
| 4,538,984 | 9/1985 | Nakagawa | 431/255 |
| 4,643,671 | 2/1987 | Yoshinaga | 431/344 |
| 4,810,187 | 3/1989 | Nitta | 431/344 |
| 4,938,686 | 7/1990 | Yoshinaga | 431/344 |
| 4,952,138 | 8/1990 | Ho | 431/344 |
| 5,304,060 | 4/1994 | Lin | 431/255 |

*Primary Examiner*—James C. Yeung

*Attorney, Agent, or Firm*—Pro-Techtor International

[57] ABSTRACT

A gas torch including a fuel gas container, a nozzle tube horizontally mounted on the fuel gas container, an ignition device, an ignition control button for triggering the ignition device to produce sparks, a guard covered around a part of the nozzle tube and a part of the ignition control button, a gas lever controlled to release fuel gas from the fuel gas container into the nozzle tube, and a flame adjustment wheel for regulating the flow rate of fuel gas, wherein an actuating plate is mounted on the fuel gas container around the gas lever and driven to move the gas lever between the operative position and the non-operative position; a switching lever is mounted on the fuel gas container and driven by the ignition control button to move the actuating plate in lifting the gas lever to the operative position; a push rod is extended out of the guard for moving the actuating plate backward in releasing the gas lever.

4 Claims, 5 Drawing Sheets

GAS TORCH

BACKGROUND OF THE INVENTION

The present invention relates to a gas torch, and relates more particularly to such a gas torch which includes a push rod and an actuating plate driven by the push rod to stop fuel gas.

Various gas torches have been developed for use in burning or welding things. These gas torches commonly comprise a fuel gas container, a nozzle tube horizontally mounted on the fuel gas container, an ignition device, an ignition control button for triggering the ignition device to produce sparks, and a flame adjustment wheel for regulating the flow rate of fuel gas. During a welding operation, the gas torch may have to be frequently operated to temporarily stop the flame. However, it is inconvenient to frequently turning the flame adjustment wheel in order to stop the flame.

SUMMARY OF THE INVENTION

The present invention has been accomplished to provide a gas torch which eliminates the aforesaid drawback. According to the present invention, an actuating plate is mounted on the fuel gas container around the gas lever and driven to move the gas lever in releasing fuel gas from the gas container, a switching lever is pivotably mounted on an upright support on the top side of the fuel gas container and driven by the ignition control button of the gas torch to move the actuating plate in lifting the gas lever to the operative position, and a push rod is installed for moving actuating plate backward in releasing the gas lever.

DETAILED DESCRIPTION OF THE PREFERRED EMBODIMENT

Figure 1:
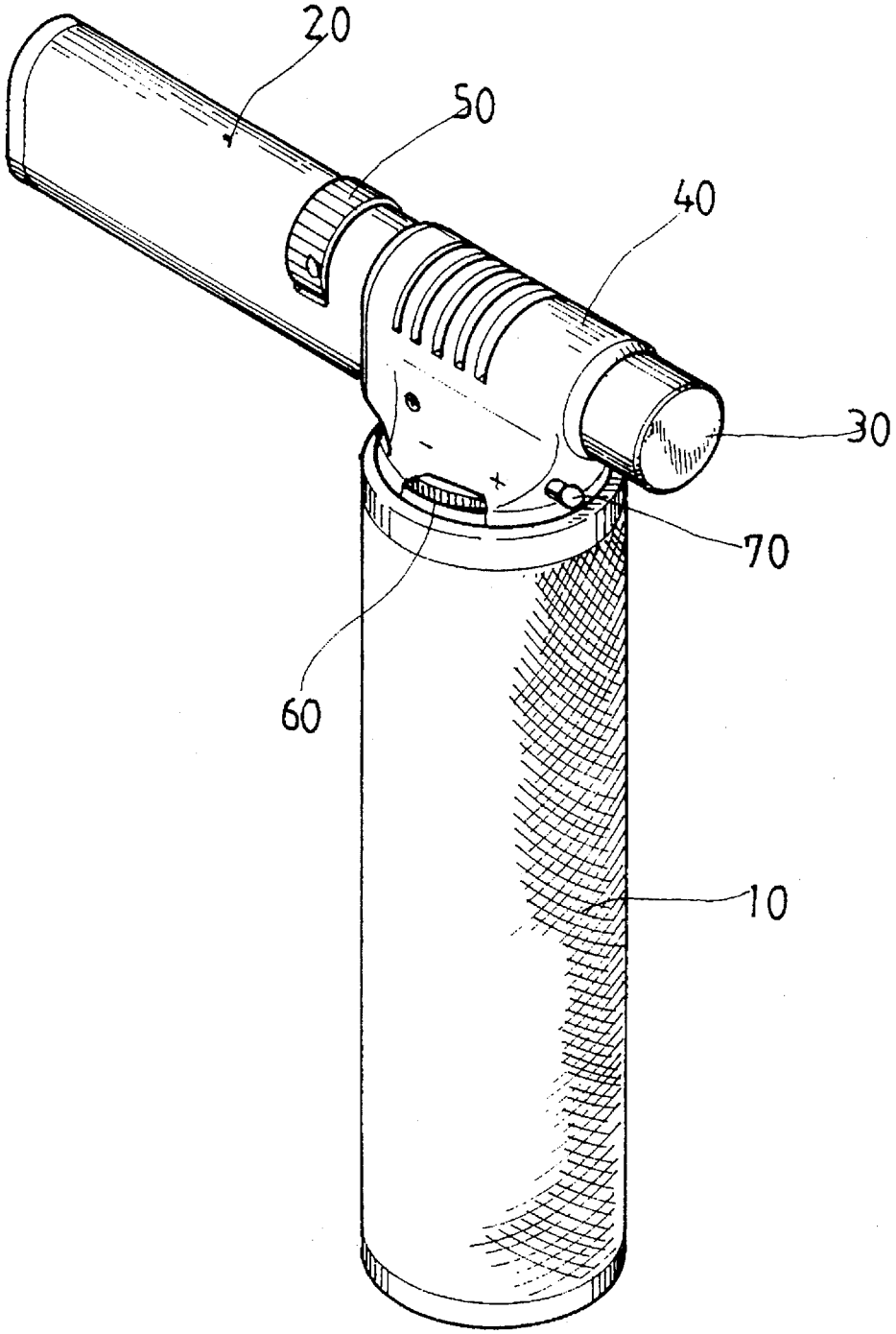
FIG. 1 is an elevational view of a gas torch according to the present invention.
Figure 2:
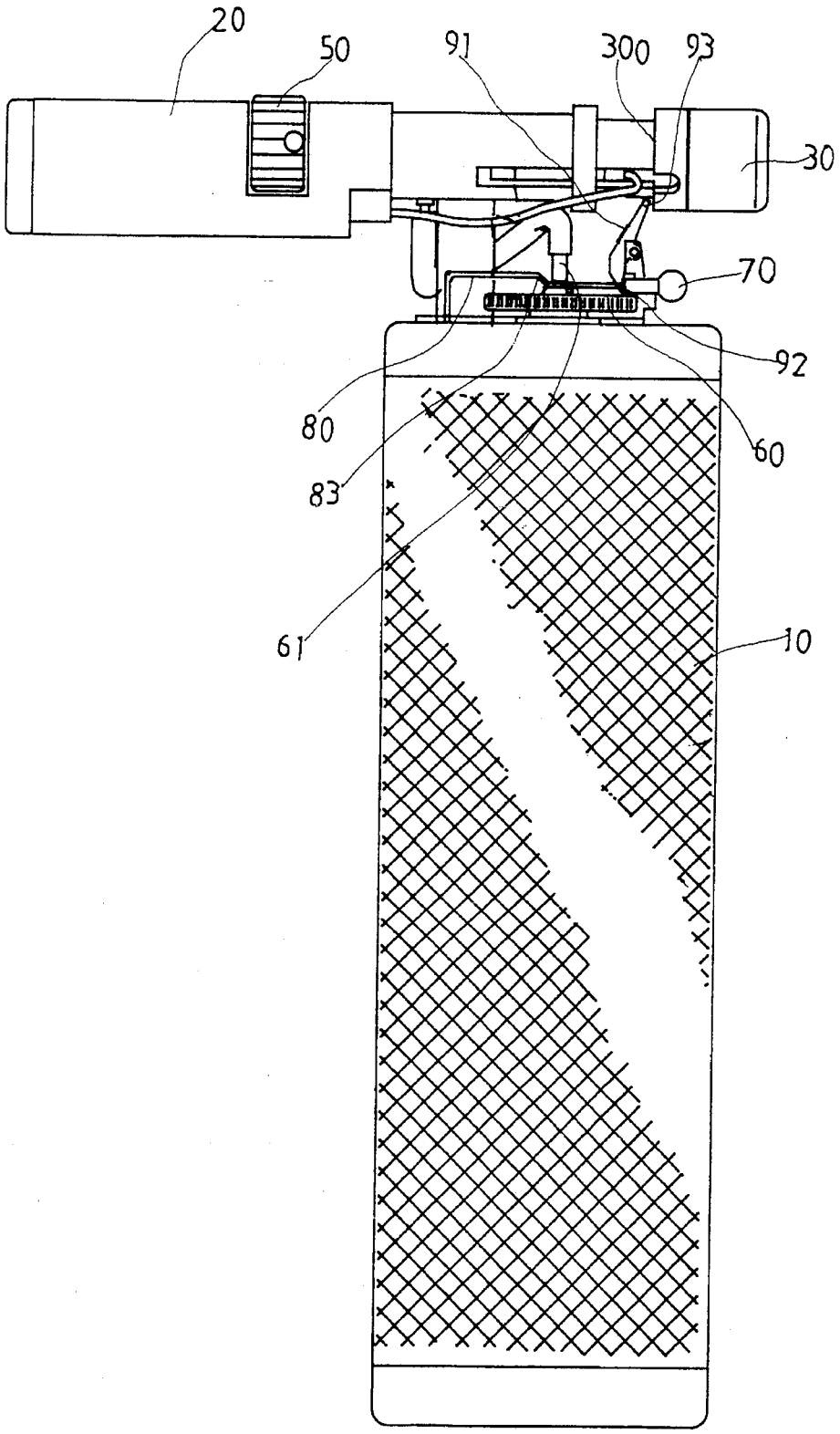
FIG. 2 is a front view of the gas torch shown in FIG. 1, showing the guard removed.
Figure 3:
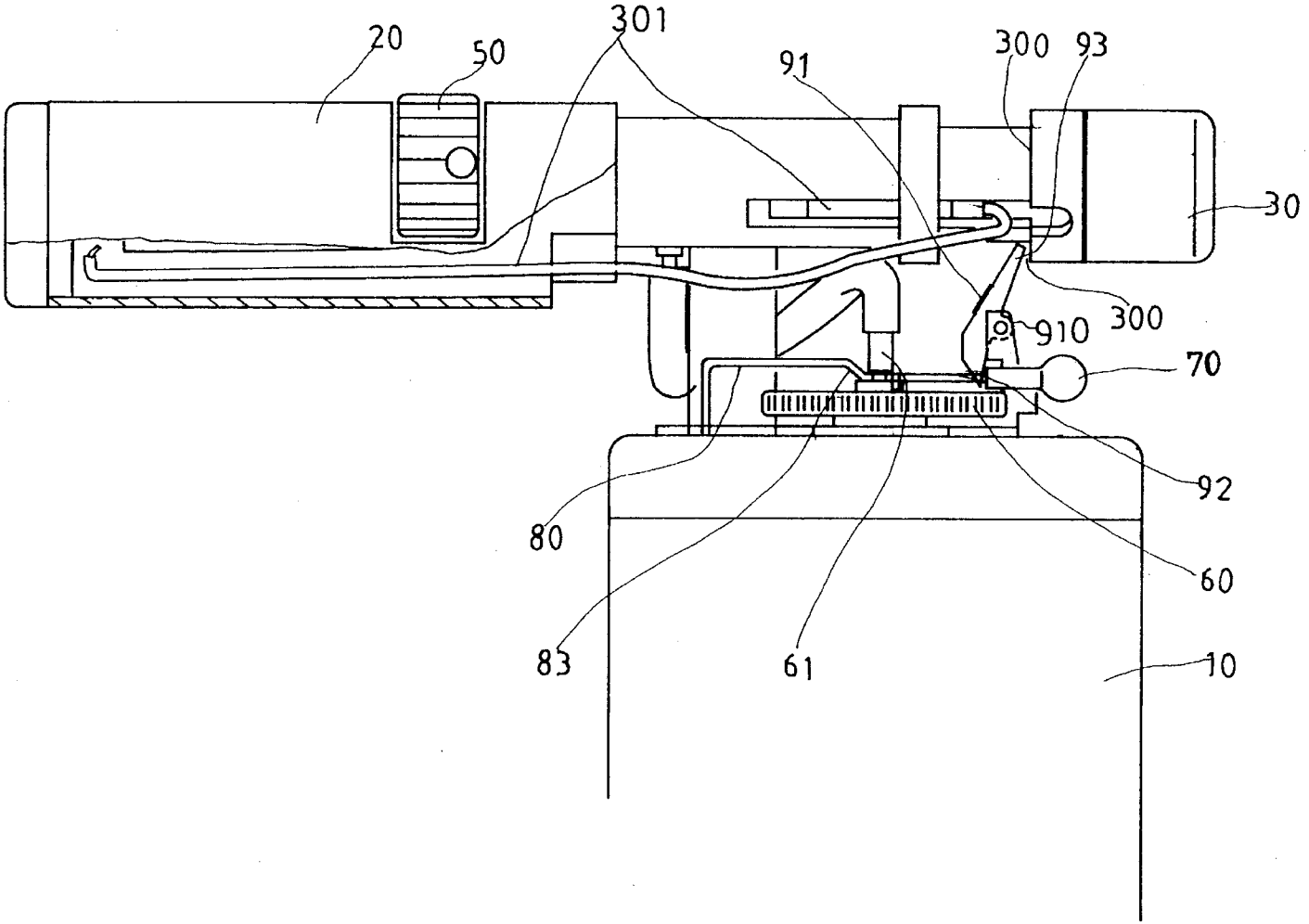
FIG. 3 is an enlarged view of the upper part of FIG. 2.

Referring to FIGS. 1, 2, and 3, a gas torch in accordance with the present invention comprises a fuel gas container 10, a nozzle tube 20 horizontally mounted on the top side of the fuel gas container 10, an ignition control button 30 mounted on the rear end of the nozzle tube 20, a guard 40 covered around the rear part of the nozzle tube 20 and the front part of the ignition control button 30, an air intake control wheel 50 mounted on the nozzle tube 20 in front of the guard 40, a flame adjustment wheel 60 mounted on the top side of the fuel gas container 10 and partially extended out of the guard 40 for regulating the flow rate of fuel gas, and a push rod 70 inserted into a hole (not shown) on the guard 40.

Figure 4:
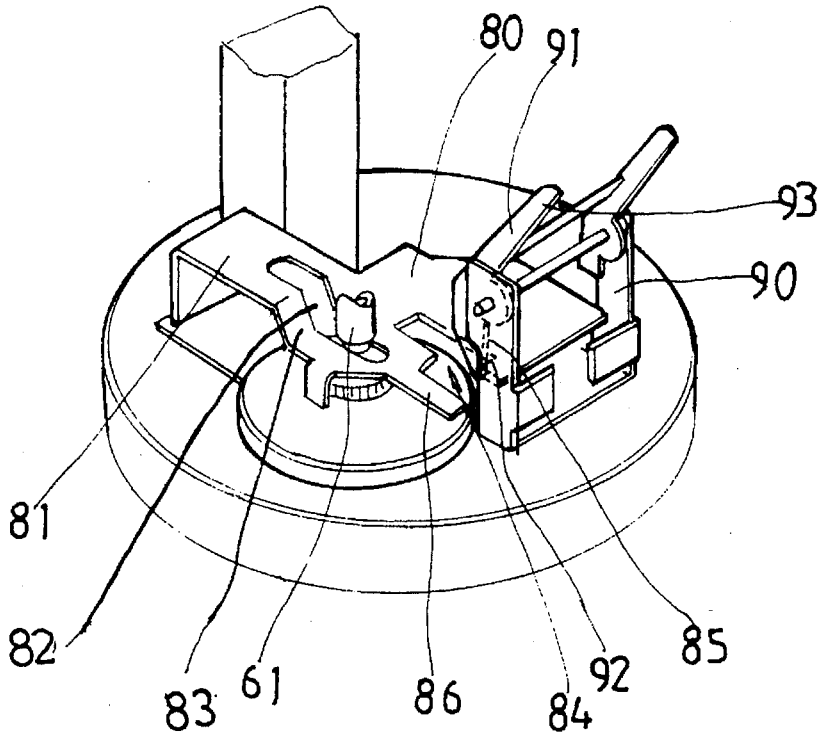
FIG. 4 is a perspective view in an enlarged scale of the actuating plate, the gas lever, the upright support, and the switching lever according to the present invention.

Referring to FIGS. 3 and 4, an actuating plate 80 is mounted on the top side of the fuel gas container 10, having a front bent 81, a downward sloping wall 83 extended from the front bent 81, an oblong slot 82 on the downward sloping wall 83 for mounting a gas lever 61, a rear opening 84, an upright stop wall 85 at one side of the rear opening 84, and a rear extension strip 86 coupled to the push rod 70. A support 90 is mounted on the top side of the fuel gas container 10 adjacent to the rear extension strip 86 to hold a switching lever 91. The switching lever 91 is turned about a pivot 910 on the support 90, having a bottom end 92 stopped at the upright stop wall 85 and a top end 93 facing the rear end 300 of the ignition control button 30.

Figure 5:
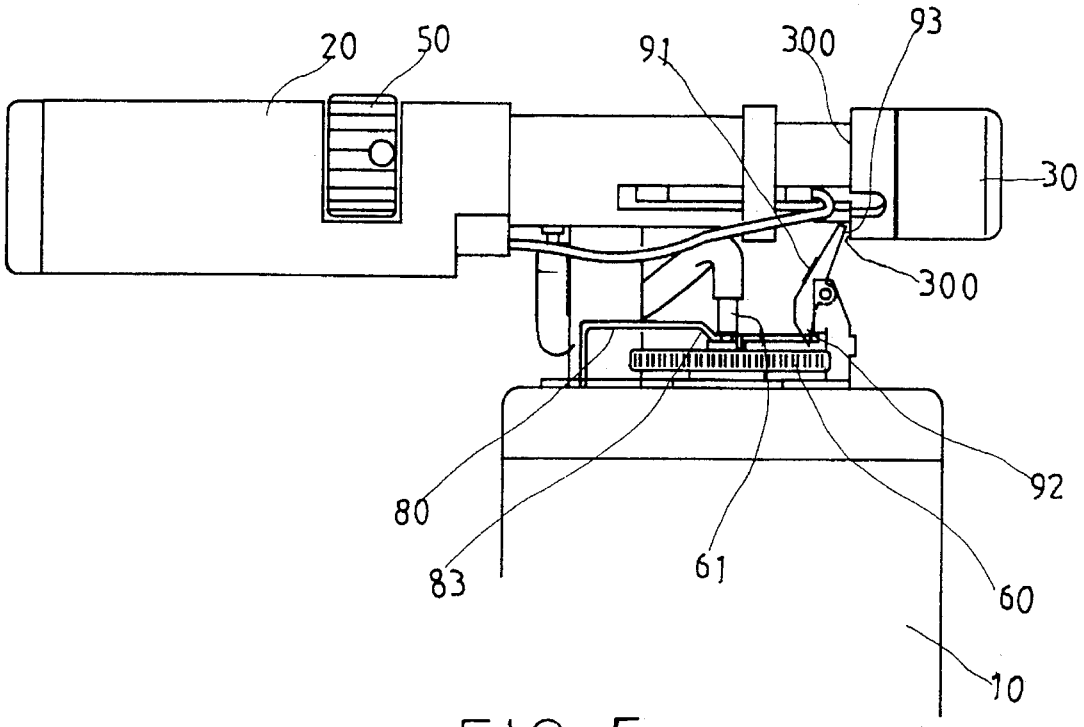
FIG. 5 is similar to FIG. 3, showing the position of the ignition control button relative to the switching lever before the operation.
Figure 6:
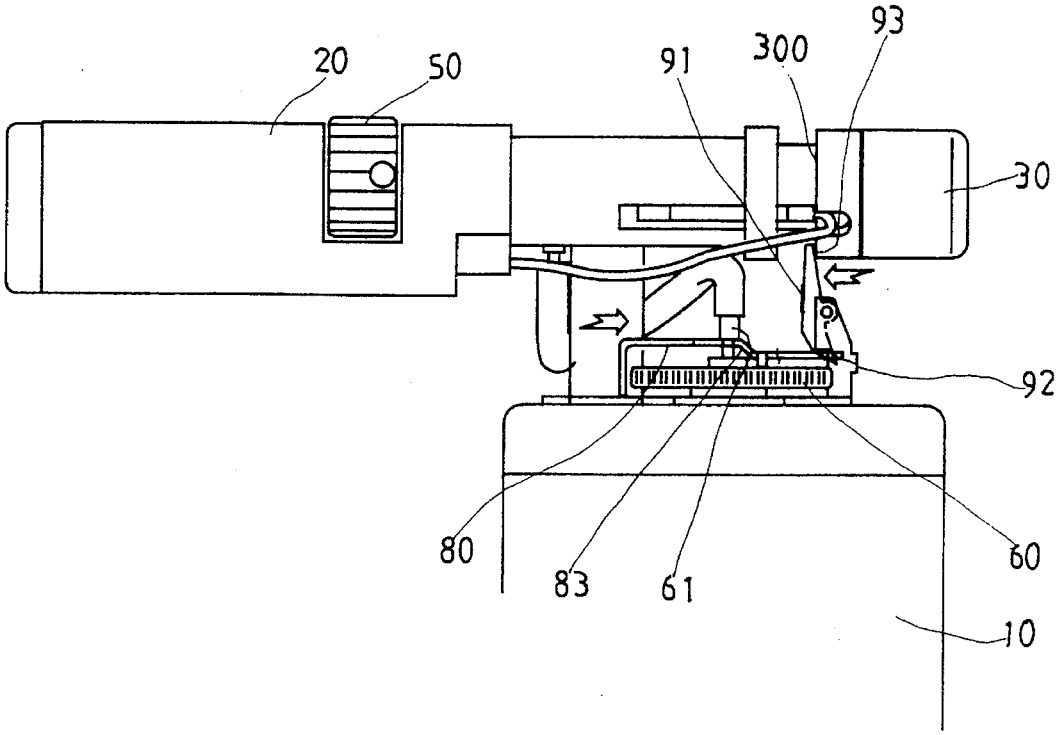
FIG. 6 is similar to FIG. 5 but showing the ignition control button depressed and the actuating plate moved by the switching lever.

FIG. 5 shows the ignition control button 30 disposed in the non-operative position. When the ignition control button 30 is depressed to force the rear end 300 against the top end 93 of the switching lever 91 as shown in FIG. 6, the switching lever 91 is turned about the respective pivot to move the actuating plate 80, causing the gas lever 61 moved upwards by the sloping wall 83 to release fuel gas from the fuel gas container 10 into the nozzle tube 20, and at the same time the ignition mechanism (see FIG. 3) of the gas torch is triggered by the ignition control button 30 to produce sparks, causing a flame produced at the front end of the nozzle tube 20.

Referring to FIGS. 1 and 2 again, when the push rod 70 is pushed inwards, the actuating plate 80 is moved back to its former position, and therefore the gas lever 61 is forced back to its former position by a spring (not shown), causing the fuel gas passage closed.

It is to be understood that the drawings are designed for purposes of illustration only, and are not intended as a definition of the limits and scope of the invention disclosed.

I claim:

1. A gas torch comprising:

a fuel gas container, a nozzle tube mounted on said fuel gas container, an ignition device, an ignition control button that when pushed activates said ignition device, a guard that covers a part of said nozzle tube and a part of said ignition control button, said guard has a push rod extending therefrom, a gas lever that controls the flow of fuel gas from said fuel gas container to said nozzle tube, and a flame adjustment wheel to regulate the amount of fuel gas that flows from said fuel gas container to said nozzle tube; wherein said ignition control button, in addition to activating said ignition device, causes a switching lever mounted on said fuel gas container to move an actuating plate also mounted on said fuel gas container, said actuating plate moves said gas lever from a non-operative position to an operative position, allowing fuel gas to flow from said fuel gas container to said nozzle tube where said fuel gas is ignited by sparks generated by said ignition device, and said push rod drives said actuating plate to its initial position, causing said gas lever to return to its non-operative position.

2. The gas torch of claim 1 wherein:

said actuating plate includes a sloping wall and an oblong slot that receives the gas lever therein, said sloping wall driving said gas lever from said non-operative position to said operative position when said actuating plate is moved by said switching lever.

3. The gas torch of claim 1 wherein:

said switching lever turns about a pivot on a support, said switching lever has a top end situated so as to be contacted by said ignition control button when said ignition control button is depressed, said switching lever has a bottom end connected to said actuating plate.

4. The gas torch of claim 1 wherein:

said actuating plate includes a rear opening to receive said switching lever, said actuating plate further includes a rear extension strip connected to said push rod.

* * * * *